US011408175B2

(12) United States Patent
Faries et al.

(10) Patent No.: US 11,408,175 B2
(45) Date of Patent: Aug. 9, 2022

(54) EMBEDDED POLE ADAPTER ASSEMBLY

(71) Applicant: Meyer Utility Structures, LLC, Dallas, TX (US)

(72) Inventors: Guy L. Faries, Memphis, TN (US); Daniel G. Beard, Olive Branch, MS (US)

(73) Assignee: MEYER UTILITY STRUCTURES, LLC, Dallas, TX (US)

( * ) Notice: Subject to any disclaimer, the term of this patent is extended or adjusted under 35 U.S.C. 154(b) by 0 days.

(21) Appl. No.: 17/196,409

(22) Filed: Mar. 9, 2021

(65) Prior Publication Data

US 2021/0285215 A1 Sep. 16, 2021

Related U.S. Application Data

(60) Provisional application No. 62/987,736, filed on Mar. 10, 2020.

(51) Int. Cl.
*E04C 3/34* (2006.01)
*E04H 12/34* (2006.01)

(52) U.S. Cl.
CPC ..... *E04C 3/34* (2013.01); *E04H 12/347* (2013.01)

(58) Field of Classification Search
CPC ... E02D 27/42; E02D 5/80; E04C 3/34; E04C 3/30; E04H 12/2269; E04H 12/2215; E04H 12/2276; E04H 12/347
USPC ..... 52/165
See application file for complete search history.

(56) References Cited

U.S. PATENT DOCUMENTS 4,983,074 A * 1/1991 Carruba ..... E02B 17/027 405/204
8,109,057 B2 * 2/2012 Stark ..... E04H 12/2215 52/297
9,091,037 B2 * 7/2015 Fairbairn ..... E04H 12/2261
2010/0229415 A1 * 9/2010 Knudsen ..... E04H 12/2284 33/613
2010/0257794 A1 * 10/2010 Stark ..... E04H 12/2215 52/158
2011/0222957 A1 * 9/2011 Marques Lito Velez Grilo ..... E02D 27/42 403/4
2013/0227897 A1 * 9/2013 Palmer ..... E02D 27/42 52/157
2013/0227898 A1 * 9/2013 Fairbairn ..... E02D 27/42 52/169.9

* cited by examiner

*Primary Examiner* — Gregory W Adams
(74) *Attorney, Agent, or Firm* — Baker Botts, LLP

(57) ABSTRACT

A device that includes pier caps. Each pier cap is configured to couple to a pole that is at least partially embedded below a surface of a ground. The device further includes threaded rods coupled with the pier caps. The device further includes an assembly frame that includes a base plate and coupling arms. The base plate includes a first plurality of openings that are configured to interface with a structure that is installed onto the base plate. The first plurality of openings are configured to allow a position of the structure to be adjusted radially about the base plate. Each coupling arm includes a second plurality of openings that are configured to allow a position of the assembly frame to be adjusted along a horizontal plane. Each coupling arm is coupled to a threaded rod and a position for each coupling arm is adjustable vertically along the threaded rod.

17 Claims, 4 Drawing Sheets

EMBEDDED POLE ADAPTER ASSEMBLY

CROSS-REFERENCE TO RELATED APPLICATIONS

This application claims benefit of U.S. Provisional Patent Application No. 62/987,736 filed Mar. 10, 2020, by Guy L. Faries, et al, and entitled "Embedded Pole Adapter Assembly," which is incorporated herein by reference as if reproduced in its entirety.

TECHNICAL FIELD

This disclosure relates generally to embedded pole systems and, more particularly, installing structures onto an embedded pole system.

BACKGROUND

Installing structures and/or poles that are embedded in the ground is time-consuming and typically requires large equipment. This process typically involves installing a concrete foundation for mounting a structure or pole. For example, this process may involve digging a hole into the ground which creates spoils. The spoils are later backfilled into the ground to secure the concrete foundation. Removing excess spoils may also require additional machinery and may introduce environmental issues based on the content of the spoils. Providing concrete to a job site typically requires large concrete trucks. Some job sites have limited access which prevents concrete trucks from being able to provide concrete to the job site. This means that other equipment and/or structures from a job site may have to be removed to provide access for the concrete trucks and other equipment. This introduces additional time delays for the installation process because of the time required to remove and reinstall equipment from the job site. In addition, using concrete to build a foundation requires a significant amount of curing time before a structure can be installed onto the foundation. For example, a concrete foundation may have a curing time of twenty-eight days. This introduces at least a one-month delay before a structure can be installed onto the foundation.

SUMMARY

Disclosed herein are various embodiments of an embedded pole adapter assembly for mounting poles or structures onto poles that are embedded in the ground. Installing the embedded pole adapter assembly does not require a concrete foundation which means that the embedded pole adapter assembly can be installed without needing access for concrete trucks and without the delays associated with the installation time and curing time for concrete. This means that the embedded pole adapter assembly enables poles and structures to be installed in a shorter amount of time compared to existing techniques. In addition, the embedded pole adapter assembly may be installed without creating excess spoils that would need to be disposed of.

In one embodiment, an embedded pole adapter assembly that includes pier caps, threaded rods, and an assembly frame. Each pier cap is configured to couple to a pole that is at least partially embedded below a surface of a ground. Each threaded rod is coupled to one of the pier caps. The assembly frame includes a base plate and coupling arms. The base plate includes a first plurality of openings that are configured to interface with a structure that is installed onto the base plate. The first plurality of openings are configured to allow a position of the structure to be adjusted radially about the base plate. Each coupling arm includes a second plurality of openings that are configured to allow a position of the assembly frame to be adjusted along a horizontal plane. Each coupling arm is coupled to a threaded rod and a position for each coupling arm is adjustable vertically along the threaded rod.

In another embodiment, an embedded pole system includes a plurality of embedded poles. Each pole is embedded at least partially below a surface of a ground. Each pole is also configured such that at least a portion of the pole is above the surface of the ground. The embedded pole system further includes an embedded pole adapter assembly that includes pier caps, threaded rods, and an assembly frame. Each pier cap is configured to couple to a pole that is at least partially embedded below a surface of a ground. Each threaded rod is coupled to one of the pier caps. The assembly frame includes a base plate and coupling arms. The base plate includes a first plurality of openings that are configured to interface with a structure that is installed onto the base plate. The first plurality of openings are configured to allow a position of the structure to be adjusted radially about the base plate. Each coupling arm includes a second plurality of openings that are configured to allow a position of the assembly frame to be adjusted along a horizontal plane. Each coupling arm is coupled to a threaded rod and a position for each coupling arm is adjustable vertically along the threaded rod. The embedded pole system further includes the structure coupled to the embedded pole adapter device.

In yet another embodiment, an embedded pole adapter device installation method includes coupling a plurality of pier caps to a plurality of poles. The method further includes coupling a plurality of threaded rods to the plurality of pier caps such that each threaded rod is coupled with a pier cap from among the plurality of pier caps. The method further includes coupling an assembly frame to the plurality of threaded rods. The assembly frame includes a base plate and coupling arms. The base plate includes a first plurality of openings that are configured to interface with a structure that is installed onto the base plate. The first plurality of openings are configured to allow a position of the structure to be adjusted radially about the base plate. Each coupling arm includes a second plurality of openings that are configured to allow a position of the assembly frame to be adjusted along a horizontal plane. Each coupling arm is coupled to a threaded rod and a position for each coupling arm is adjustable vertically along the threaded rod.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Embedded Pole Adapter Assembly Overview

Figure 1:
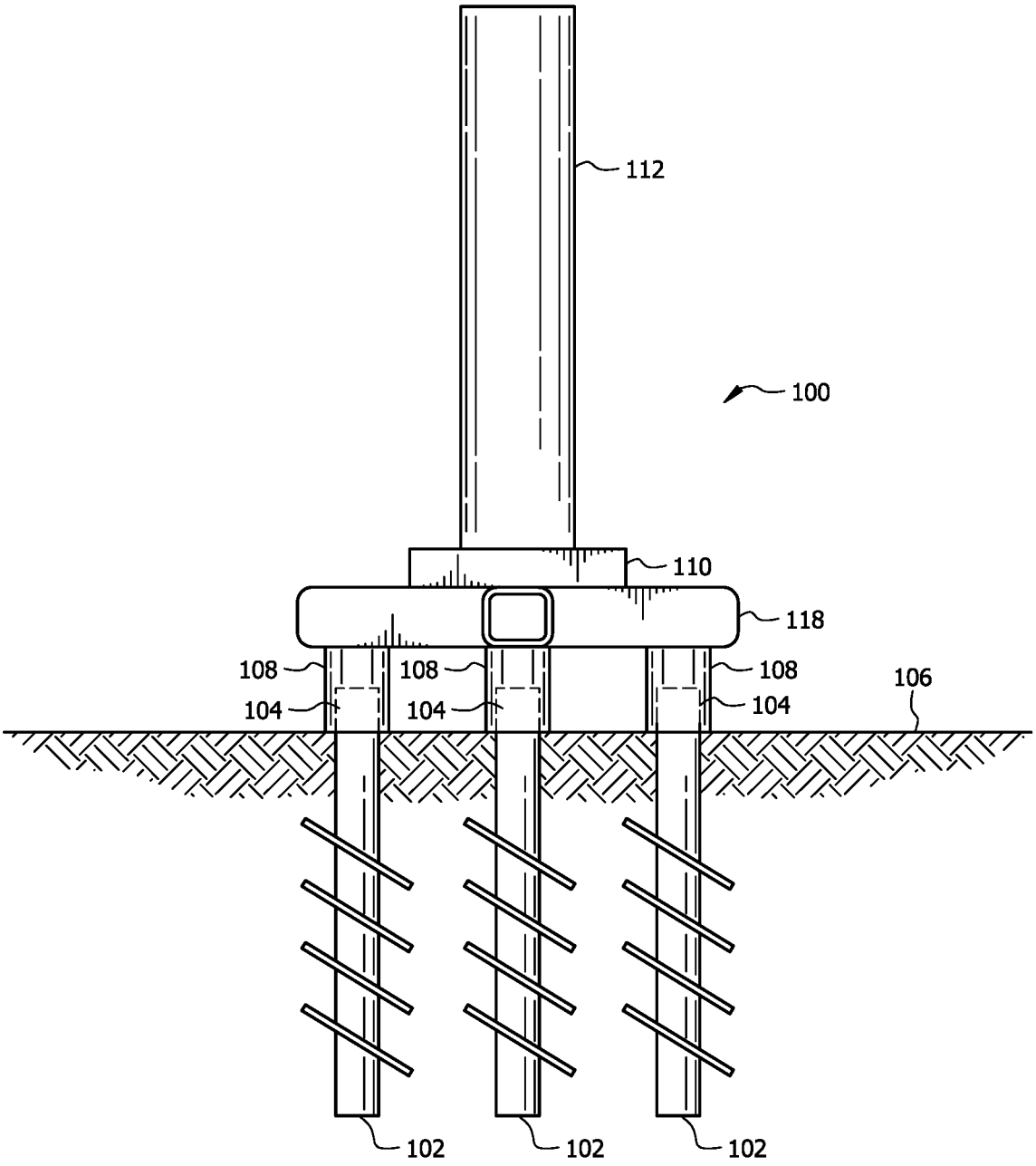
FIG. 1 is a cutaway view of an embodiment of an installed embedded pole adapter assembly.

FIG. 1 is a cutaway view of an embodiment of an installed embedded pole adapter assembly 100. The embedded pole adapter assembly 100 is generally configured to provide an interface that couples a structure 112 to one or more embedded poles 102 that are installed into the ground 106. Examples of structures 112 include, but are not limited to, poles, electrical power substation equipment, circuit breakers, transformers, switches, lightning arrestors, telecommunications equipment, storage tanks, or any other suitable type of structure or equipment. In one embodiment, the embedded pole adapter assembly 100 may be used to support a multi-pole structure that has cross braces that couples multiple poles together. In this example, an embedded pole adapter assembly 100 may be attached to each pole in the multi-pole structure. This configuration allows the orientation of the pole to be individually adjusted (e.g. rotated, tilted, shifted, etc.) to level the cross braces. In other examples, the embedded pole adapter assembly 100 may be used to support a mono-pole structure.

In FIG. 1, a plurality of embedded poles 102 is installed into the ground 106. Examples of embedded poles 102 include, but are not limited to, helical piers. The embedded poles 102 are installed into the ground 106 such that at least a portion 104 of each embedded pole 102 is exposed above the surface of the ground 106. The portion 104 of the embedded pole 102 that is exposed above the surface of the ground 106 may be six inches, one foot, two feet, or any other suitable length. For example, the embedded poles 102 may be helical piers that are screwed into the ground 106.

The embedded pole adapter assembly 100 is configured to be installed onto the embedded poles 102 without requiring a concrete foundation. Once the embedded pole adapter assembly 100 is installed, a structure 112 can be immediately installed onto the embedded pole adapter assembly 100 without any of the delays associated with using a concrete foundation such as curing time. The embedded pole adapter assembly 100 comprises a plurality of pier caps 108 that are each coupled to a portion 104 of an embedded pole 102 that is exposed above the surface of the ground 106. For example, each pier cap 108 may be a cylindrical tube with an inner diameter that allows the pier cap 108 to slide onto the outer diameter of the portion 104 of the embedded pole 102 that is exposed above the surface of the ground 106. Each pier cap 108 may be coupled to an embedded pole 102 using any suitable technique. For example, each pier cap 108 may be bolted or fastened to the portion 104 of an embedded pole 102.

The embedded pole adapter assembly 100 further comprises a base plate 110 that is configured to couple the embedded pole adapter assembly 100 to a structure 112. The base plate 110 may be coupled to the structure 112 using any suitable technique. For example, the base plate 110 may be bolted or fastened to the structure 112. Additional information about the pier caps 108, the base plate 110, and the embedded pole adapter assembly 100 is described with respect to FIGS. 2 and 3. An example of an installation process for the embedded pole adapter assembly 100 is described with respect to FIG. 5. Once the structure 112 is installed onto the embedded pole adapter assembly 100, the embedded pole adapter assembly 100 is configured to support and secure the structure 112.

Embedded Pole Adapter Assembly with Three Coupling Arms

Figure 2:
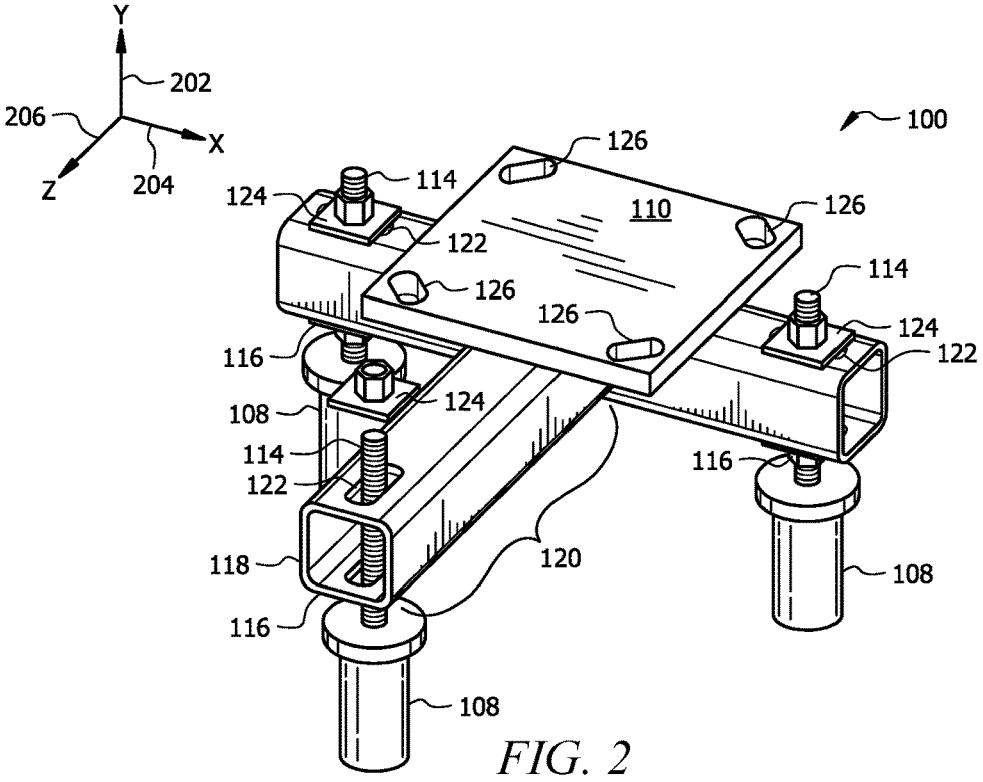
FIG. 2 is a perspective view of an embodiment of an embedded pole adapter assembly.

FIG. 2 is a perspective view of an embodiment of an embedded pole adapter assembly 100. In one embodiment, an embedded pole adapter assembly 100 comprises pier caps 108, threaded rods 114, leveling hardware 116, an assembly frame 118, frame coupling fasteners 124, and a base plate 110. The embedded pole adapter assembly 100 may be configured as shown in FIG. 2 or any other suitable configuration.

Pier Caps

Pier cap 108 in this embodiment is a tubular structure that is configured to interface with an embedded pole 102. For example, a pier cap 108 may be a cylindrical tube with an inner diameter that allows the pier cap 108 to slide onto the outer diameter of the portion 104 of the embedded pole 102 that is exposed above the surface of the ground 106. A pier cap 108 may be formed to have any suitable length, shape, or wall thickness. In some embodiments, a pier cap 108 may comprise one or more holes, slots, or openings that allow the pier cap 108 to be fastened to an embedded pole 102. For example, a pier cap 108 may comprise a plurality of bolt holes that allows the pier cap 108 to be fastened to an embedded pole 102 using bolts. In other examples, the pier cap 108 may be configured to interface and to couple with an embedded pole 102 using any other suitable technique. The cross-section of the pier caps 108 may be rectangular, circular, or any other suitable shape. For example, the cross-section of the pier caps 108 is circular in FIGS. 2 and 3. As another example, the cross-section of the pier caps 108 is rectangular in FIGS. 4A and 4B.

Threaded Rods

Each pier cap 108 further comprises a threaded interface that is configured to receive a threaded rod 114. For example, a pier cap 108 may comprise a threaded hole that allows a threaded rod 114 to be screwed into and fastened to the pier cap 108. A threaded rod 114 is configured to couple a pier cap 108 to the assembly frame 118. Examples of a threaded rod 114 include, but are not limited to, a threaded rod, a bolt, or any other type of hardware with a threaded portion. The threaded rod 114 may be any suitable length or diameter.

Leveling Hardware

Examples of leveling hardware 116 include, but are not limited to, nuts, brackets, or any other suitable type of hardware. In FIG. 2, the leveling hardware 116 is represented by nuts and brackets located on the underside of each coupling arm 120 of the assembly frame 118. The leveling hardware 116 is generally configured to allow the assembly frame 118 to be repositioned or adjusted along the y-axis. For example, the leveling hardware 116 may be configured to position the assembly frame 118 and the base plate 110 to be substantially parallel with the ground 106. The leveling hardware 116 is configured to be installed onto a threaded rod 114 such that the position of the leveling hardware 116 is adjustable with respect to the y-axis 202. For example, the leveling hardware 116 is adjustable once it is installed on a threaded rod 114 which allows the leveling hardware 116 to be moved up or down the threaded rod 114.

Assembly Frame

The assembly frame 118 is generally configured to provide an interface that couples embedded poles 102 within the ground to a structure 112. The assembly frame 118 is configured to support the weight of the structure 112 and to prevent the structure 112 from moving or falling over. The assembly frame 118 is configured to receive and couple with a structure 112 using a base plate 110. Additional details about the base plate 110 are described below.

The assembly frame 118 is configured to be installed onto the leveling hardware 116 on the threaded rod 114. In one embodiment, the assembly frame 118 is a tubular structure that forms a plurality of coupling arms 120. The cross-section of the tubular structure may be rectangular, circular, or any other suitable shape. For example, the cross-section of the tubular structure may be a 4-inch by 4-inch square, an 8-inch by 8-inch square, or any other suitable size cross-section. In one embodiment, the assembly frame 118 is formed of steel. In other embodiments, the assembly frame 118 may be formed using any other suitable type of material.

Referring to the example in FIG. 2, the assembly frame 118 comprises three coupling arms 120. Each coupling arm 120 may be configured to any suitable length. For example, a coupling arm 120 may have a length of one foot, two feet, three feet, five feet, ten feet, or any other suitable length. Each coupling arm 120 comprises a plurality of openings 122. In one embodiment, the openings 122 are oversized slots. In this configuration, the openings 122 are configured to allow the assembly frame 118 to move with respect to the x-axis 204 and the z-axis 206.

Frame Coupling Hardware

The frame coupling fasteners 124 are generally configured to couple and secure the assembly frame 118 to the threaded rod 114 and the pier cap 108. For example, the frame coupling fasteners 124 may comprise nuts and washers that are threaded onto the threaded rod 114 to fasten the assembly frame 118 to the threaded rod 114 and the pier caps 108. Once the frame coupling fasteners 124 are positioned and tightened, the position of the assembly frame 118 becomes fixed with respect to the x-axis 204 and the z-axis 206. Examples of the frame coupling fasteners 124 include, but are not limited to, nuts, brackets, or any other suitable type of hardware.

Base Plate

The base plate 110 is generally configured to couple a structure 112 to the embedded pole adapter assembly 100. The base plate 110 is coupled to the assembly frame 118. For example, the base plate 110 may be coupled to the assembly frame 118 using welds, bolts, fasteners, or any other suitable type of coupling technique. In FIG. 2, the base plate 110 comprises a rectangular shape. In other embodiments, the base plate 110 may be circular, hexagonal, or any other suitable shape. The base plate 110 may also be configured with any suitable size or thickness. In one embodiment, the base plate 110 is formed of steel. In other embodiments, the base plate 110 may be formed using any other suitable type of material.

The base plate 110 comprises a plurality of openings 126 (e.g. holes or slots) that are positioned and shaped to correspond with openings on a structure 112. For example, the base plate 110 may comprise four openings 126 that correspond with four openings on a base of a structure. In this example, the openings 126 are positioned to line up with the openings on the base of the structure 112 which allows bolt fasteners to be used to couple the base plate to the structure 112. In one embodiment, the openings 126 are radial slots that allow the position of the structure 112 to be rotated about the y-axis 202.

Embedded Pole Adapter Assembly with Four Coupling Arms

Figure 3:
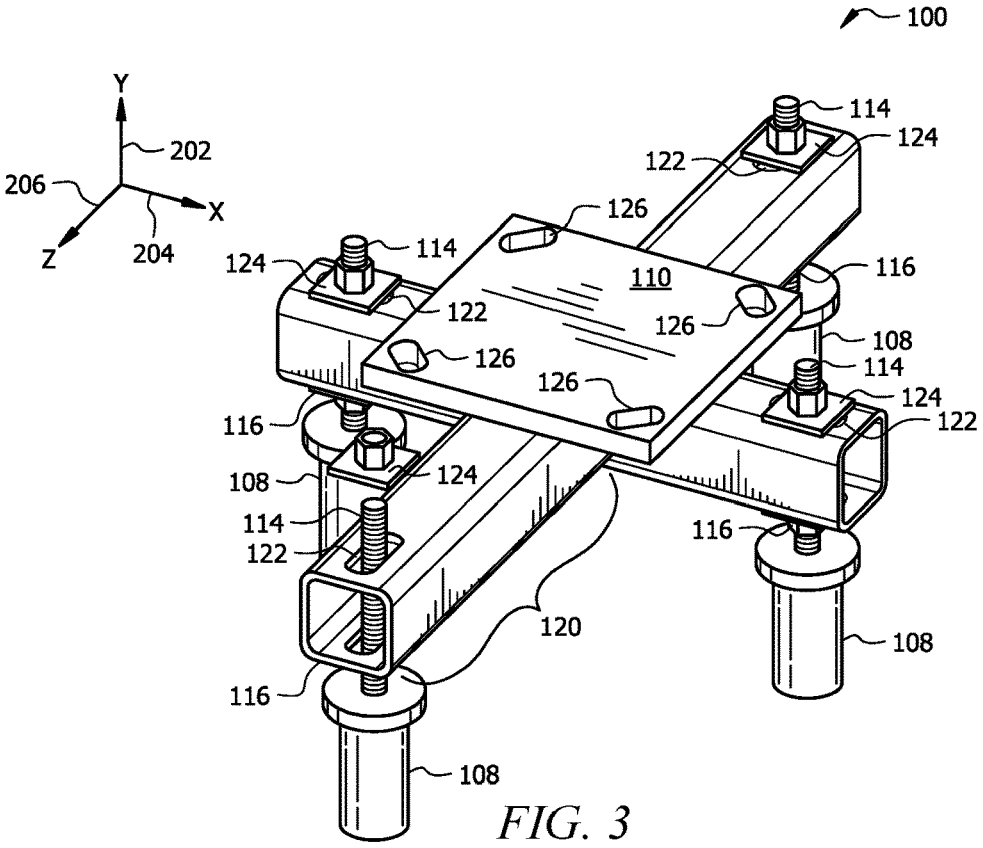
FIG. 3 is a perspective view of another embodiment of an embedded pole adapter assembly.

FIG. 3 is a perspective view of another embodiment of an embedded pole adapter assembly 100. In the previous embodiment, the embedded pole adapter assembly 100 comprised three coupling arms 120. In FIG. 3, the embedded pole adapter assembly 100 comprises four coupling arms 120. The embedded pole adapter assembly 100 may comprise additional coupling arms 120 to provide additional stability or support. For example, the embedded pole adapter may comprise more than three coupling arms 120 for heavier load structures or structures with larger moments. In other embodiments, the embedded pole adapter assembly 100 may comprise any other suitable number of coupling arms 120.

Embedded Pole Adapter Assembly with a Modified Base Plate

Figure 4A:
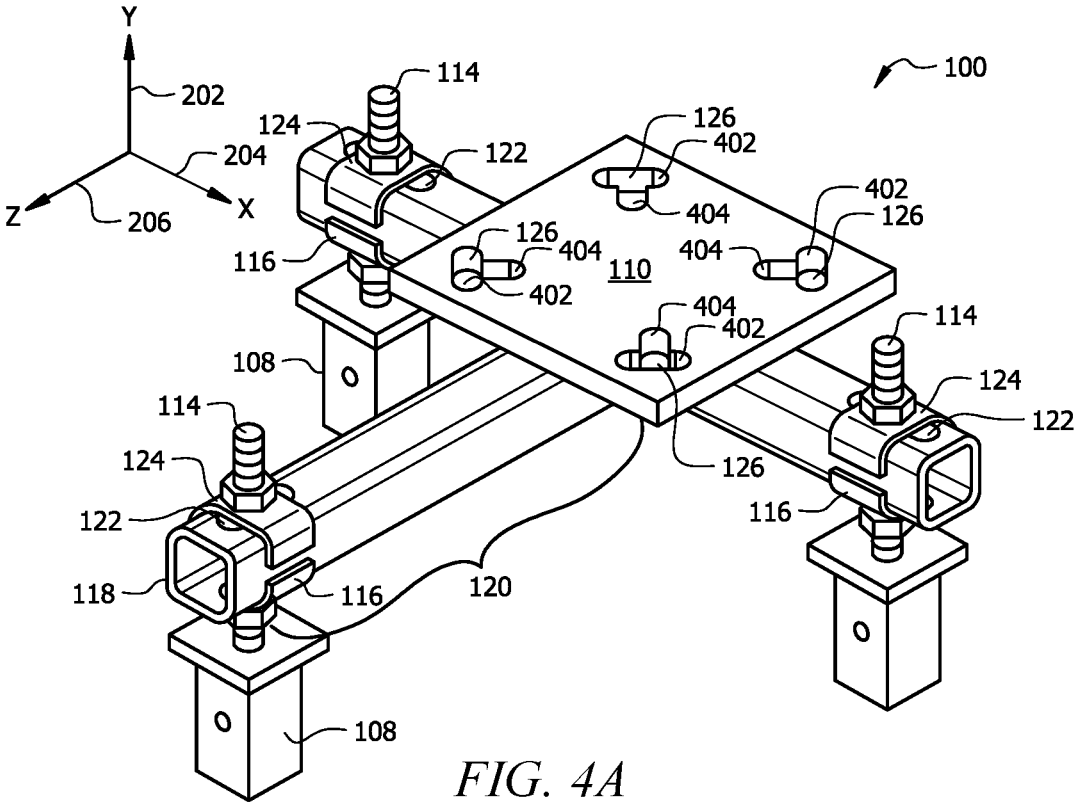
FIGS. 4A and 4B are a perspective view of another embodiment of an embedded pole adapter assembly.
Figure 4B:
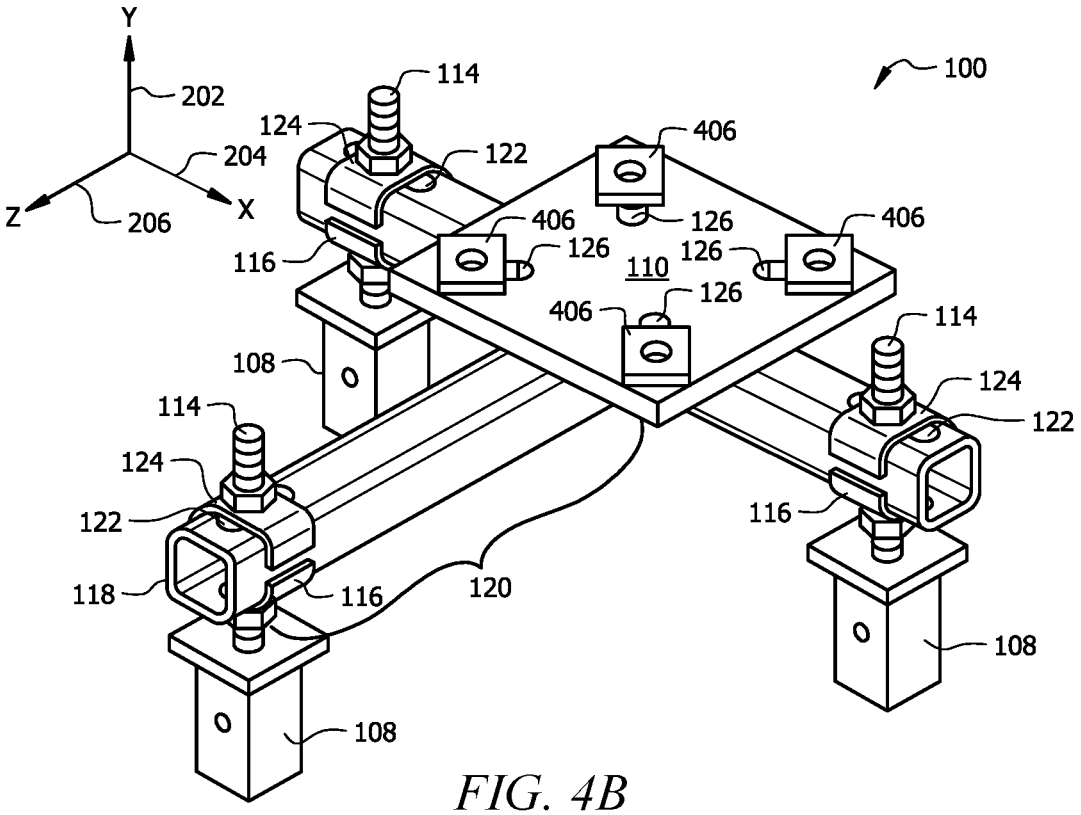

FIGS. 4A and 4B are a perspective view of another embodiment of an embedded pole adapter assembly 100. The configuration shown in FIGS. 4A and 4B allows the embedded pole adapter assembly 100 to attach to structures 112 with a square anchor bolt pattern. In FIG. 4A, the openings 126 in the base plate 110 are T-shaped. In this configuration, each opening 126 comprises a first portion 402 that allows the position of the structure 112 to be rotated about the y-axis 202 and a second portion 404 that allows the mounting locations for the anchor bolts of the structure 112 to be adjusted horizontally about the x-axis 204 and the z-axis 206. By adjusting the mounting locations of the anchor bolts, the base plate 110 can support structures 112 having different size diameters. For example, the base plate 110 can support anchor bolt patterns with an eight-inch diameter, a twelve-inch diameter, or any other suitable size diameter. As shown in FIG. 4B, washers or fasteners 406 may be installed above and/or below the openings 126 to control the movement of the anchor bolts of the structure 112 within the openings 126.

Embedded Pole Adapter Assembly Installation Process

Figure 5:
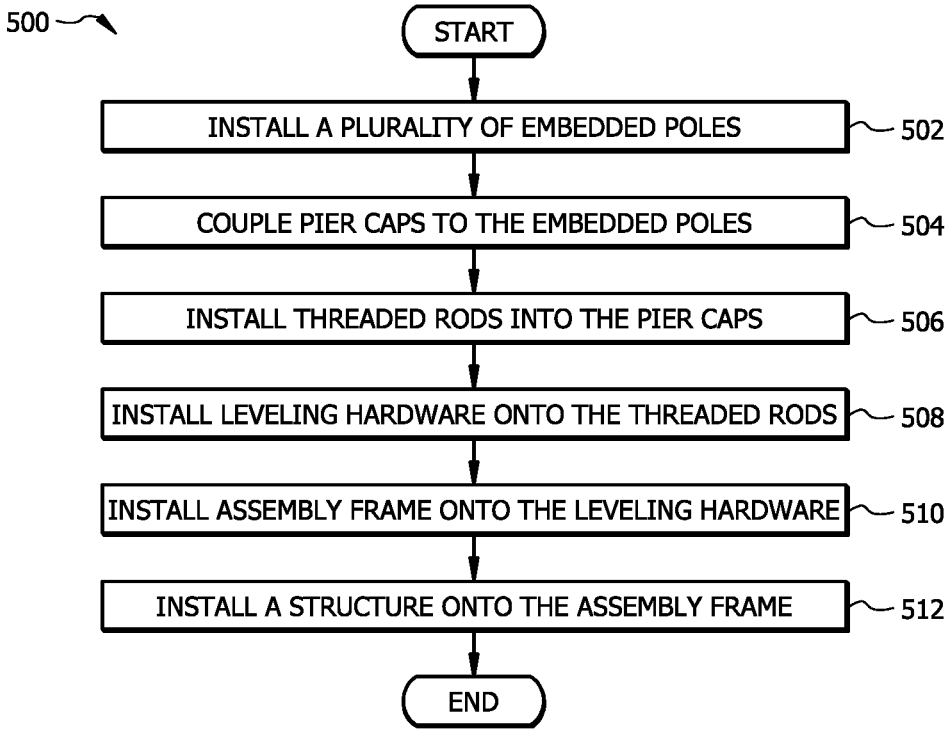
FIG. 5 is a flowchart of an embodiment of an installation method for an embedded pole adapter assembly.

FIG. 5 is a flowchart of an embodiment of an installation method 500 for an embedded pole adapter assembly 100. Method 500 may be implemented by one or more technicians or installers to install a structure 112 at a job site using an embedded pole adapter assembly 100.

At step 502, an installer installs a plurality of embedded poles 102. For example, an installer may drill a plurality of embedded poles 102 (e.g. helical piers) into the ground 106 at a location where a structure 112 is going to be installed. In this example, each embedded pole 102 may be pressed and/or screwed into the ground 106. Once an embedded pole 102 is installed into the ground 106, the installer may then backfill any removed soil or spoils to secure the embedded pole 102 into the ground 106. In other examples, the installer may install a plurality of embedded poles 102 using any other suitable technique. The plurality of embedded poles 102 are each installed into the ground 106 such that at least a portion 104 of each embedded pole 102 is exposed above the surface of the ground 106. The embedded poles 102 provide a secure base for a structure 112 to be installed onto without using a concrete foundation. This allows a structure 112 to be installed without the need to accommodate large concrete trucks and without any delays associated with removing and reinstalling other equipment from a job site.

At step 504, the installer installs pier caps 108 onto the plurality of embedded poles 102. Here, the installer may place pier caps 108 on top of the exposed portions 104 of the embedded poles 102. The installer may secure the pier caps 108 to the exposed portions 104 of the embedded poles 102 using bolts, fasteners, or any other suitable technique.

At step 506, the installer installs threaded rods 114 onto the pier caps 108. Here, the installer may thread threaded rods 114 into each of the pier caps 108. For example, each pier cap 108 may comprise a threaded opening that is configured to receive a threaded rod 114. Each threaded rod 114 is installed onto a pier cap 108 such that a portion of the threaded rod 114 is exposed to allow for the installation of an assembly frame 118.

At step 508, the installer installs leveling hardware 116 onto the threaded rods 114. The installer may thread leveling hardware 116 onto each of the threaded rods 114. The leveling hardware 116 may be positioned on the threaded rod 114 to level the assembly frame 118 once it is installed onto the leveling hardware 116 and the threaded rods 114. For example, the leveling hardware 116 may be configured to position the assembly frame 118 and the base plate 110 to be substantially parallel with the ground 106. Once the assembly frame 118 is positioned vertically, the installer may then use the leveling hardware 116 to fix the position of the assembly frame 118 and to prevent any further vertical movement of the assembly frame 118.

At step 510, the installer installs the assembly frame 118 onto the leveling hardware 116. The installer installs the assembly frame 118 such that a threaded rod 114 is positioned within each of the openings 122 of the assembly frame 118. Once the assembly frame 118 is leveled vertically using the leveling hardware 116, the installer may then adjust the position of the assembly frame 118 horizontally using the openings 122 of the assembly frame 118. Once the assembly frame 118 is positioned horizontally, the installer may then install frame coupling fasteners 124 to fix the position of the assembly frame 118 and to prevent any further horizontal movement of the assembly frame 118.

At step 512, the installer installs the structure 112 onto the base plate 110 of the embedded pole adapter assembly 100. The installer may first align any openings in the base of the structure 112 with the openings 126 in the base plate 110 and then may use a plurality of fasteners to secure the structure 112 to the base plate 110. Before the installer completely tightens the fasteners to secure the structure 112 to the base plate 110, the installer may rotate the structure (e.g. about the y-axis 202) to reposition the structure 112. Once the structure is positioned, the installer may complete tightening the fasteners to secure the structure 112 to the base plate 110.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. An embedded pole adapter device, comprising:
- a plurality of pier caps, wherein each pier cap is configured to couple to a pole that is at least partially embedded below a surface of a ground;
- a plurality of threaded rods, wherein each threaded rod is coupled with a pier cap from among the plurality of pier caps;
- an assembly frame comprising:
  - a base plate comprising a first plurality of openings configured to interface with a structure installed onto the base plate, wherein the first plurality of openings is configured to allow a position of the structure to be adjusted radially about the base plate; and
  - a plurality of coupling arms coupled to the base plate, wherein:
    - each coupling arm comprises a second plurality of openings configured to allow a position of the assembly frame to be adjusted along a horizontal plane;
    - each coupling arm is coupled to a threaded rod from among the plurality of threaded rods; and
    - a position for each coupling arm is adjustable vertically along a threaded rod; and
- a plurality of leveling brackets, wherein each leveling bracket is configured to:
  - couple to a threaded rod from among the plurality of threaded rods below a coupling arm from among the plurality of coupling arms;
  - adjust a vertical position for the coupling arm along the threaded rod; and
  - maintain the vertical position for the coupling arm with respect to the threaded rod.

2. The device of claim 1, wherein each pier cap is configured to be above the surface of the ground when coupled to the pole that is at least partially below the surface of the ground.

3. The device of claim 1, wherein each pier cap comprises a tubular structure with an inner diameter sized to fit over at least a portion of the pole that is above the surface of the ground.

4. The device of claim 1, further comprising a plurality of frame coupling fasteners, wherein each frame coupling fastener is configured to:

couple to a threaded rod from among the plurality of threaded rods above a coupling arm from among the plurality of coupling arms; and maintain a horizontal position for the coupling arm with respect to the threaded rod.

5. The device of claim 1, wherein the plurality of coupling arms comprises three coupling arms.

6. The device of claim 1, wherein the plurality of coupling arms comprises four coupling arms.

7. An embedded pole system, comprising:

a plurality of poles, wherein:

each pole is embedded at least partially below a surface of a ground; and at least a portion of each pole is above the surface of the ground;

an embedded pole adapter device, comprising:

a plurality of pier caps, wherein each pier cap is configured to couple to a pole from among the plurality of poles;

a plurality of threaded rods, wherein each threaded rod is coupled with a pier cap from among the plurality of pier caps; and an assembly frame comprising:

a base plate comprising a first plurality of openings configured to interface with a structure installed onto the base plate, wherein the first plurality of openings is configured to allow a position of the structure to be adjusted radially about the base plate; and a plurality of coupling arms coupled to the base plate, wherein:

each coupling arm comprises a second plurality of openings configured to allow a position of the assembly frame to be adjusted along a horizontal plane;

each coupling arm is coupled to a threaded rod from among the plurality of threaded rods; and a position for each coupling arm is adjustable vertically along a threaded rod;

the structure coupled to the embedded pole adapter device; and a plurality of leveling brackets, wherein each leveling bracket is configured to:

couple to a threaded rod from among the plurality of threaded rods below a coupling arm from among the plurality of coupling arms;

adjust a vertical position for the coupling arm along the threaded rod; and maintain the vertical position for the coupling arm with respect to the threaded rod.

8. The system of claim 7, wherein at least a portion of each pier cap is configured to be above the surface of the ground when coupled to the pole that is at least partially below the surface of the ground.

9. The system of claim 7, wherein each pier cap comprises a tubular structure with an inner diameter sized to fit over at least a portion of the pole that is above the surface of the ground.

10. The system of claim 7, further comprising a plurality of frame coupling fasteners, wherein each frame coupling fastener is configured to:

couple to a threaded rod from among the plurality of threaded rods above a coupling arm from among the plurality of coupling arms; and maintain a horizontal position for the coupling arm with respect to the threaded rod.

11. The system of claim 7, wherein the plurality of coupling arms comprises three coupling arms.

12. The system of claim 7, wherein the plurality of coupling arms comprises four coupling arms.

13. An embedded pole adapter device installation method, comprising:

coupling a plurality of pier caps to a plurality of poles, wherein:

each pole is at least partially embedded below a surface of a ground; and at least a portion of each pole is above the surface of the ground;

coupling a plurality of threaded rods to the plurality of pier caps, wherein each threaded rod is coupled with a pier cap from among the plurality of pier caps;

coupling an assembly frame to the plurality of threaded rods, wherein the assembly frame comprises:

a base plate comprising a first plurality of openings configured to interface with a structure installed onto the base plate, wherein the first plurality of openings is configured to allow a position of the structure to be adjusted radially about the base plate; and a plurality of coupling arms coupled to the base plate, wherein:

each coupling arm comprises a second plurality of openings configured to allow a position of the assembly frame to be adjusted along a horizontal plane;

each coupling arm is coupled to a threaded rod from among the plurality of threaded rods; and a position for each coupling arm is adjustable vertically along a threaded rod; and wherein coupling the assembly frame to the plurality of threaded rods comprises coupling a plurality of leveling brackets to the plurality threaded rods, wherein each leveling bracket is configured to:

couple to a threaded rod from among the plurality of threaded rods below a coupling arm from among the plurality of coupling arms;

adjust a vertical position for the coupling arm along the threaded rod; and maintain the vertical position for the coupling arm with respect to the threaded rod.

14. The method of claim 13, wherein coupling the assembly frame to the plurality of threaded rods comprises coupling a plurality of frame coupling fasteners to the plurality threaded rods, wherein each frame coupling fastener is configured to:

couple to a threaded rod from among the plurality of threaded rods above a coupling arm from among the plurality of coupling arms; and maintain a horizontal position for the coupling arm with respect to the threaded rod.

15. The method of claim 13, further comprising embedding the plurality of poles below the surface of the ground.

16. The method of claim 13, further comprising coupling the structure to the base plate.

17. The method of claim 13, wherein the plurality of coupling arms comprises at least three coupling arms.

* * * * *